US006743120B1

(12) United States Patent
Chen

(10) Patent No.: US 6,743,120 B1
(45) Date of Patent: Jun. 1, 2004

(54) IRON GOLF CLUB HEAD

(76) Inventor: Archer C. C. Chen, No. 501, 28th Road, Taichung Industrial Park, Taichung (TW)

( * ) Notice: Subject to any disclaimer, the term of this patent is extended or adjusted under 35 U.S.C. 154(b) by 0 days.

(21) Appl. No.: 10/365,410

(22) Filed: Feb. 13, 2003

(51) Int. Cl.[7] ..... A63B 53/04
(52) U.S. Cl. ..... 473/349; 473/350
(58) Field of Search ..... 473/324, 345, 473/346, 347, 348, 349, 350, 290, 291, 342

(56) References Cited

U.S. PATENT DOCUMENTS 5,460,371 A * 10/1995 Takeda ..... 473/345
5,536,011 A * 7/1996 Gutowski ..... 473/350
5,584,770 A * 12/1996 Jensen ..... 473/350
5,683,310 A * 11/1997 Chen ..... 473/349
5,776,011 A * 7/1998 Su et al. ..... 473/345
6,458,045 B1 * 10/2002 Chen ..... 473/342
6,506,129 B2 * 1/2003 Chen ..... 473/329

FOREIGN PATENT DOCUMENTS

GB 2251556 * 7/1992 ..... 273/167 R

* cited by examiner

*Primary Examiner*—Sebastiano Passaniti
(74) *Attorney, Agent, or Firm*—Browdy and Neimark, P.L.L.C.

(57) ABSTRACT

An iron golf club head includes a first head member and a second head member. The first head member is structurally integrally formed of a neck, a heel, and a face which includes an annular first convexity at a rear side thereof. The second head member is structurally integrally formed of a toe, a top, and a sole, and includes a second convexity corresponding in location to the first convexity. The second convexity has a recess for disposing solder. Accordingly, the first convexity and the second convexity are fastened securely to each other by soldering.

4 Claims, 3 Drawing Sheets

IRON GOLF CLUB HEAD

BACKGROUND OF THE INVENTION

1. Field of the Invention

The present invention relates generally to golf clubs, and more particularly to an improved iron golf club head.

2. Description of the Related Art

A regular golf club head is composed of a neck, a heel, a top, a sole, and a face, and includes a variety of joining methods, structures, and materials of which the above component parts are made, thereby causing a variety of advantages and disadvantages.

SUMMARY OF THE INVENTION

The present invention is particularly designed for the golf club head which has an integrated structure of the neck, heel and face thereof. The primary objective of the present invention is to provide an improved iron golf club head composed of two head members, which are respectively structurally integrally forged.

The foregoing objective of the present invention is attained by the iron golf club head, which is composed of a first head member and a second head member. The first head member is structurally integrally formed of a neck, a heel, and a face which includes a first convexity at a rear side thereof. The second head member is structurally integrally formed of a toe, a top, and a sole, and includes a second convexity corresponding in location to the first convexity. The first convexity and the second convexity are fastened securely to each other by soldering.

DETAILED DESCRIPTION OF THE INVENTION

Figure 1:
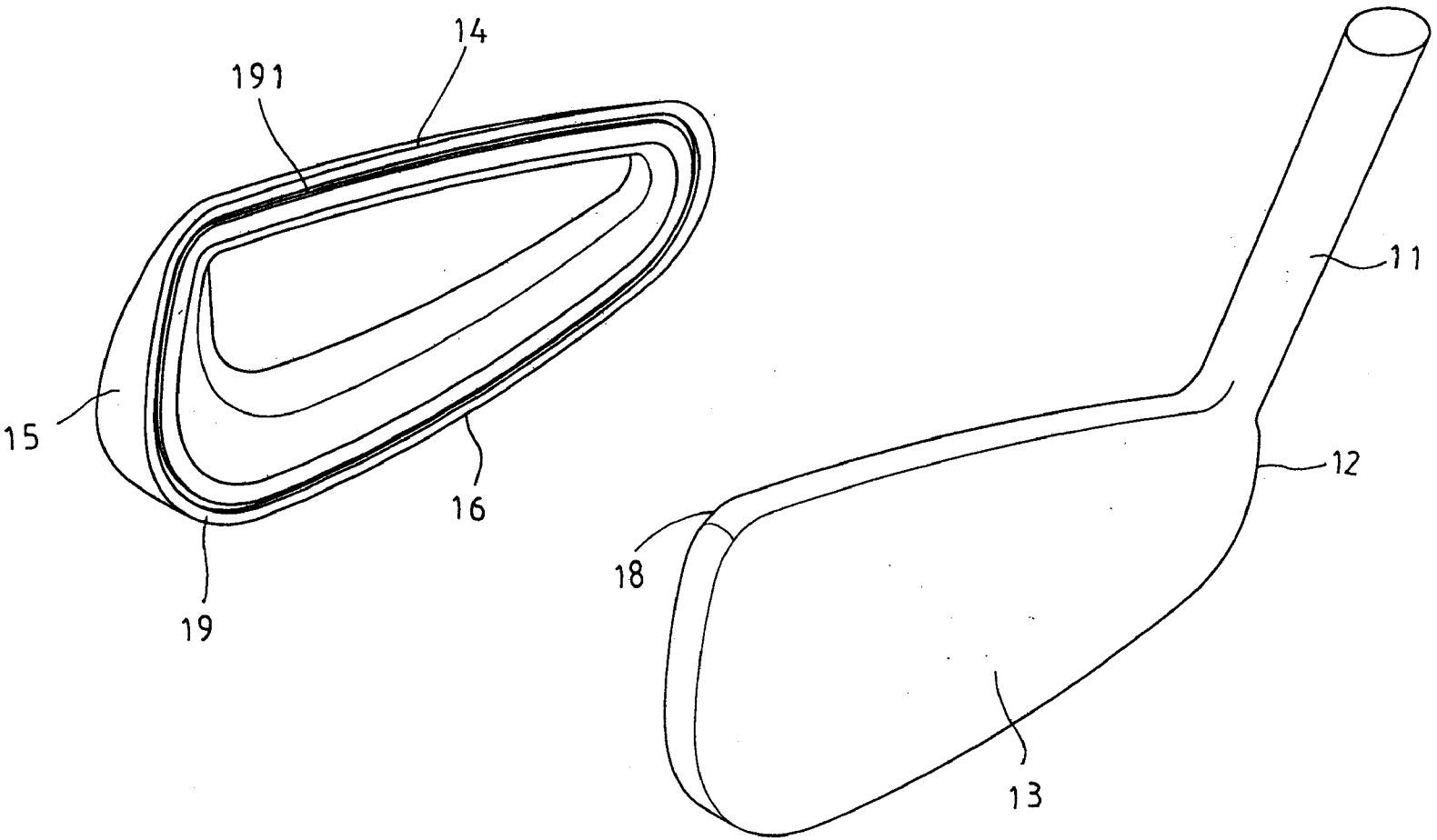
FIG. 1 is an exploded view of a preferred embodiment of the present invention.
Figure 2:
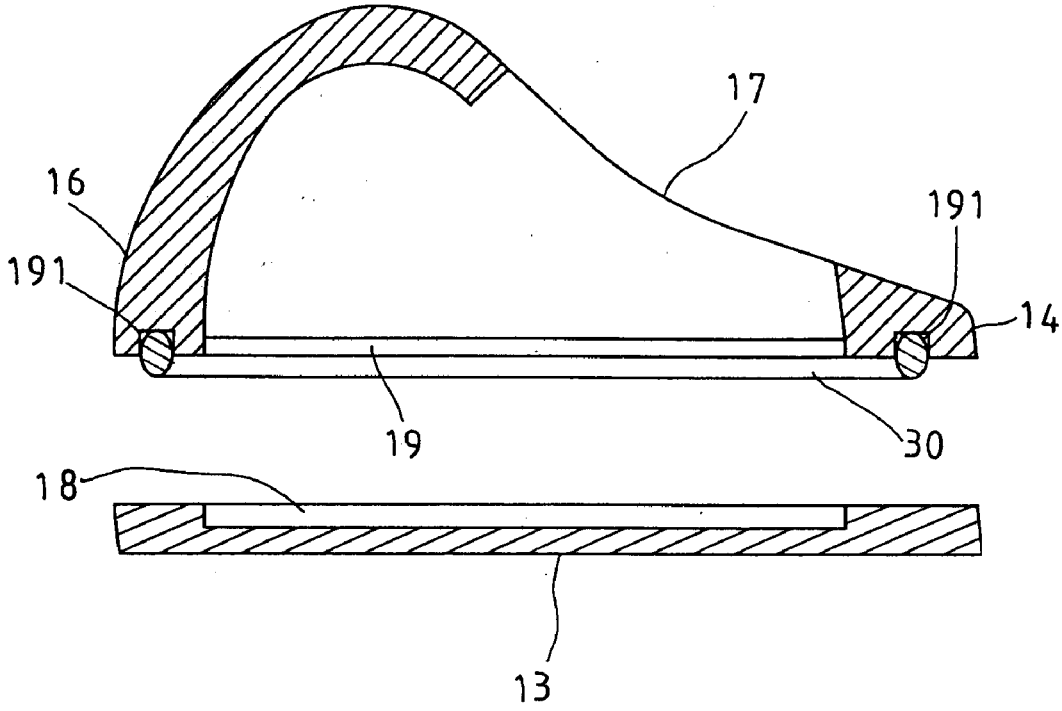
FIG. 2 is a cross-sectional view of the preferred embodiment of the present invention before a first head member and a second head member are interconnected with each other.
Figure 3:
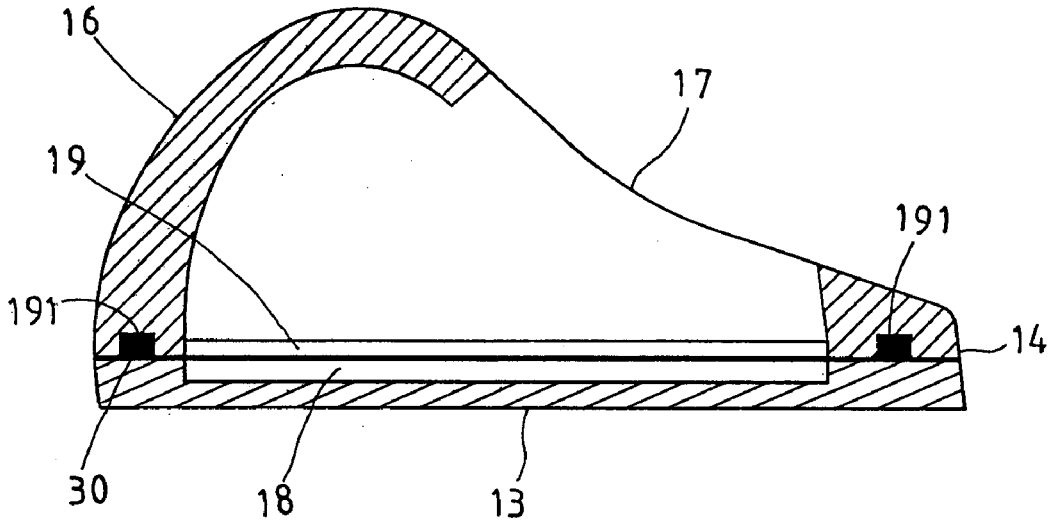
FIG. 3 is a cross-sectional view of the preferred embodiment of the present invention after the first head member and the second head member are interconnected with each other.

Referring to FIGS. 1–3, an iron golf club head of a preferred embodiment of the present invention is composed of a first head member and a second head member. The first head member is made of a light alloy, like titanium alloy, and is structurally integrally formed of a neck 11, a heel 12, and a face 13. The second head member is made of a metal heavier than the above light alloy, such as stainless steel or copper, and is structurally integrally formed of a top 14, a toe 15, and a sole 16. The golf club head is hollow and includes an open space at a back 17 thereof. The first head member includes an annular first convexity 18 protruding along a fringe of a rear side of the face 13 thereof. The second head member includes a second convexity 19 corresponding in location to the first convexity 18 and having an annular recess 191 at a fringe thereof.

While the two head members are interconnected, as illustrated in FIG. 2, the recess 191 of the first convexity 18 is disposed with solder 30, which is typically divided into a solder bar and a solder ointment. If the solder bar is selected, it can be put in the recess 191 directly. If the solder ointment is selected, it can be applied in the recess 191. Next, the first convexity 18 of the face 13 is pressed to adhere to the second convexity 19 such that the two head members are interconnected with each other. Hold the two head members by a clamp tool (not shown) to proceed to heating and soldering. In the meantime, the solder 30 is melted to be evenly disposed on the first and second convexities 18 and 19, as shown in FIG. 3, and the two head members are thereby integrally soldered.

It is to be noted that the two head members are interconnected preferably by brazing so as to be fastened preferably securely. In addition, the recess 191 can be alternatively positioned on the first convexity 18.

Figure 4:
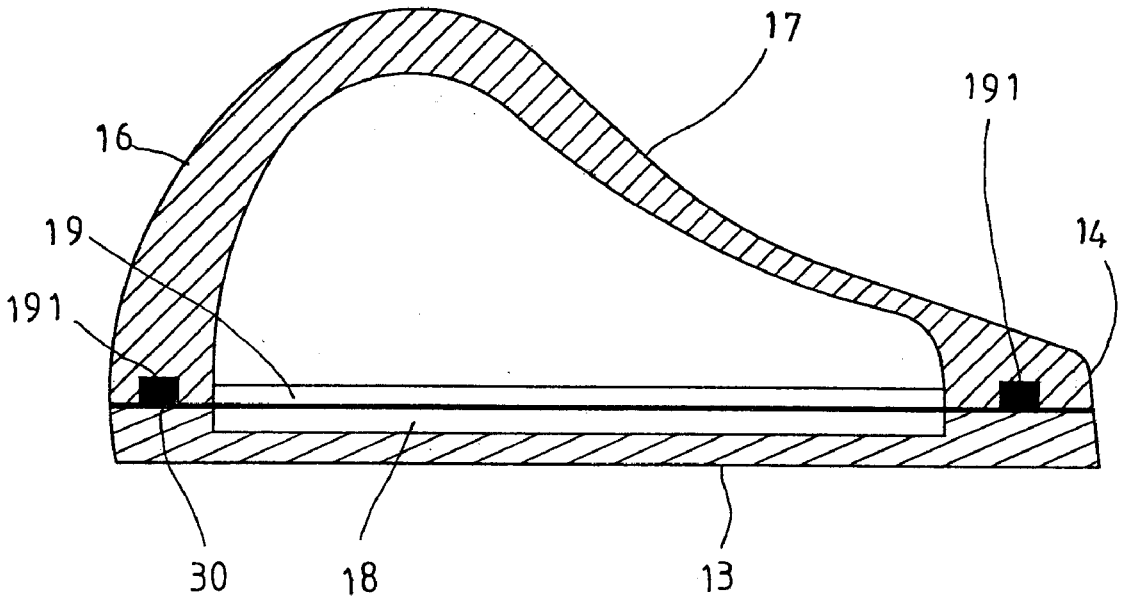
FIG. 4 similar to FIG. 3 is a cross-sectional view of another preferred embodiment of the present invention.

FIG. 4 shows another preferred embodiment of the present invention. The difference between this preferred embodiment and the aforementioned preferred embodiment of the present invention lies in that the back 17 of the golf club head is not provided with the open space.

What is claimed is:

1. An iron golf club head comprising:

a first head member integrally formed of a neck, a heel, and face, and having a first convexity at a fringe of a rear side of said face; and a second head member integrally formed of a toe, a top, and a sole, and having a second convexity corresponding in location to said first convexity;

said first convexity and said second convexity being fastened securely to each other by soldering; and wherein said first convexity comprises a recess thereon.

2. The iron golf club head as defined in claim 1, wherein said first convexity and said second convexity are fastened securely by brazing.

3. An iron golf club head comprising:

a first head member integrally formed of a neck, a heel, and face, and having a first convexity at a fringe of a rear side of said face; and a second head member integrally formed of a toe, a top, and a sole, and having a second convexity corresponding in location to said first convexity;

said first convexity and said second convexity being fastened securely to each other by soldering; and wherein said second convexity comprises a recess thereon.

4. The iron golf club head as defined in claim 3, wherein said first convexity and said second convexity are fastened securely by brazing.

* * * * *